US005661990A

United States Patent [19]

Chong

[11] Patent Number: 5,661,990

[45] Date of Patent: Sep. 2, 1997

[54] POWER TRANSFER APPARATUS FOR A WASHING MACHINE

[75] Inventor: Chan-Ho Chong, Bucheon, Rep. of Korea

[73] Assignee: Daewoo Electronics Co., Ltd, Seoul, Rep. of Korea

[21] Appl. No.: 602,930

[22] Filed: Feb. 16, 1996

[30] Foreign Application Priority Data

May 26, 1995 [KR] Rep. of Korea ..... 95-11467

[51] Int. Cl.[6] ..... D06F 37/40

[52] U.S. Cl. ..... 68/23.6

[58] Field of Search ..... 68/23.6, 23.7

[56] References Cited

U.S. PATENT DOCUMENTS 4,910,979 3/1990 Burk et al. ..... 68/23.7
5,353,613 10/1994 Smith et al. ..... 68/23.7
5,586,455 12/1996 Imai et al. ..... 68/23.7 X

*Primary Examiner*—Philip R. Coe
*Attorney, Agent, or Firm*—Anderson Kill & Olick P.C.

[57] ABSTRACT

A power transfer apparatus for use in a washing machine is provided with a gear shaft fixed to a driving shaft and including a plurality of first connection teeth formed on its periphery, a gear case rotatable about the driving shaft, fixed to a spin tub and including a spline gear downwardly extending therefrom, a planetary gear system including a sun gear connected to the driving shaft, at least one planet pinion connected to a pulsator, and an internal gear secured to the gear case, a cylindrical support fixed to the water container to surround the driving shaft and including a plurality of second connection teeth, and a cylindrical floating member for connecting the spline gear of the gear case to the first connection teeth, while keeping the gear case disconnected from the cylindrical support for a dewatering action of the machine, and for connecting the spline gear of the gear case to the second connection teeth, while keeping the gear case disconnected from the gear shaft for a washing action of the machine.

4 Claims, 7 Drawing Sheets

POWER TRANSFER APPARATUS FOR A WASHING MACHINE

FIELD OF THE INVENTION

The present invention relates to a power transfer apparatus for use in a washing machine; and, more particularly, to an improved power transfer apparatus capable of controlling rotational movements of a spin tub and a pulsator within a water container according to the operating modes of the washing machine by using an intermediate gear member having a plurality of air chambers.

DESCRIPTION OF THE PRIOR ART

In contrast to a dual-tubbed washing machine, in a single-tub type washing machine, the single spin tub is rotated or locked up, selectively, depending on an operating mode of the washing machine, e.g., a washing mode or a dewatering mode. Namely, in the washing mode, the spin tub is locked into a frame or the like of the washing machine; and only a pulsator/agitator is rotated, producing a vortex flow within the spin tub. However, in the dewatering mode, the spin tub rotates at an identical angular velocity with the pulsator. In order to coordinate the movement of the spin tub and the pulsator, various types of power transfer apparatus have been proposed.

One of the prior art power transfer apparatus is disclosed by Smith et al. in U.S. Pat. No. 5,353,613. Smith et al. teach a power transfer apparatus including an air chamber with an open mouth directed downwardly at a lower portion thereof. The air chamber is adapted to float or sink depending on whether a water container surrounding it is filled with water or not. Such upward or downward movement of the air chamber causes an agitator to be released from a spin tub or engaged with same. In the released condition from the spin tub, the agitator is rotatable with respect to the spin tub so that it can generate a vortex flow within the spin tub for a washing mode of the machine; whereas, in the engaged condition with the spin tub, the: agitator rotates together with the spin tub for a dewatering of the machine.

However, since the prior art power transfer apparatus quoted above is not provided with means for ensuring an immovable condition of the spin tub, which is required through the washing mode, it tends to lower an efficiency in generating the vortex flow within the spin tub.

SUMMARY OF THE INVENTION

It is, therefore, a primary object of the invention to provide a power transfer apparatus capable of ensuring an immovable condition of a spin tub to thereby increase an efficiency in generating a vortex flow within the spin tub.

The above and other objects of the invention are accomplished by providing a power transfer apparatus for use in a washing machine provided with a water container, a spin tub rotatable within the water container, a pulsator rotatable within the spin tub, and driving means with a driving shaft, said apparatus comprising: a gear shaft fixed to the driving shaft and including a first connection teeth formed on its periphery; a gear case rotatable about the driving shaft, fixed to the spin tub and including a spline gear downwardly extending therefrom; planetary gear means including a first gear element connected to the driving shaft, a second gear element connected to the pulsator, and a third gear element secured to the gear case; a cylindrical support fixed to the water container surrounding the driving shaft and including second connection teeth on its inner surface; and clutch means for connecting the spline gear of the gear case to the first connection teeth while keeping the gear case disconnected from the cylindrical support for the dewatering action of the machine, and for connecting the spline gear of the gear case to the second connection teeth while keeping the gear case disconnected from the gear shaft for the washing action of the machine.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1A:
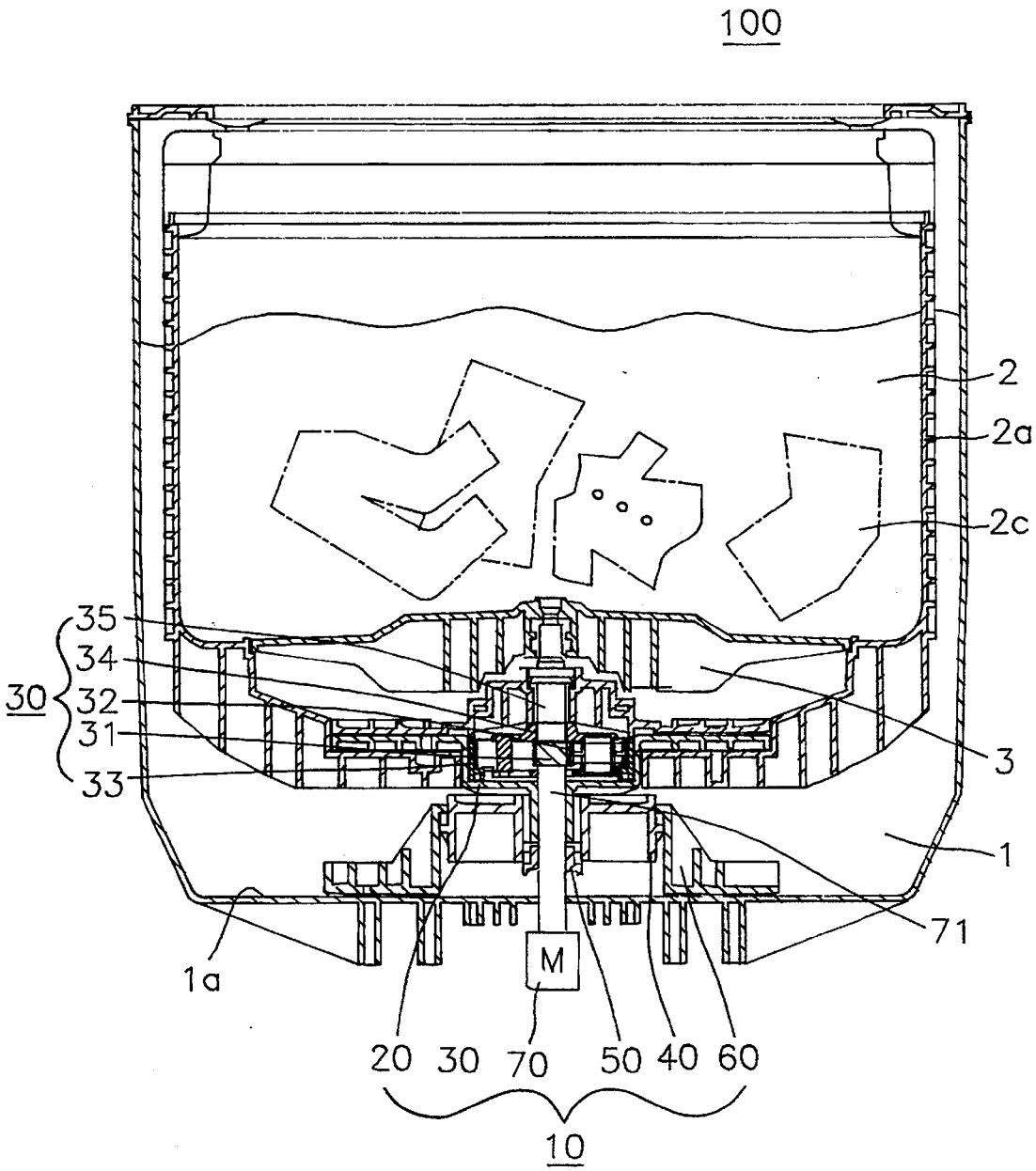
FIGS. 1A and 1B represent longitudinal sectional views of a washing machine employing the: inventive power transfer apparatus in a washing mode and a dewatering mode, respectively.
Figure 1B:
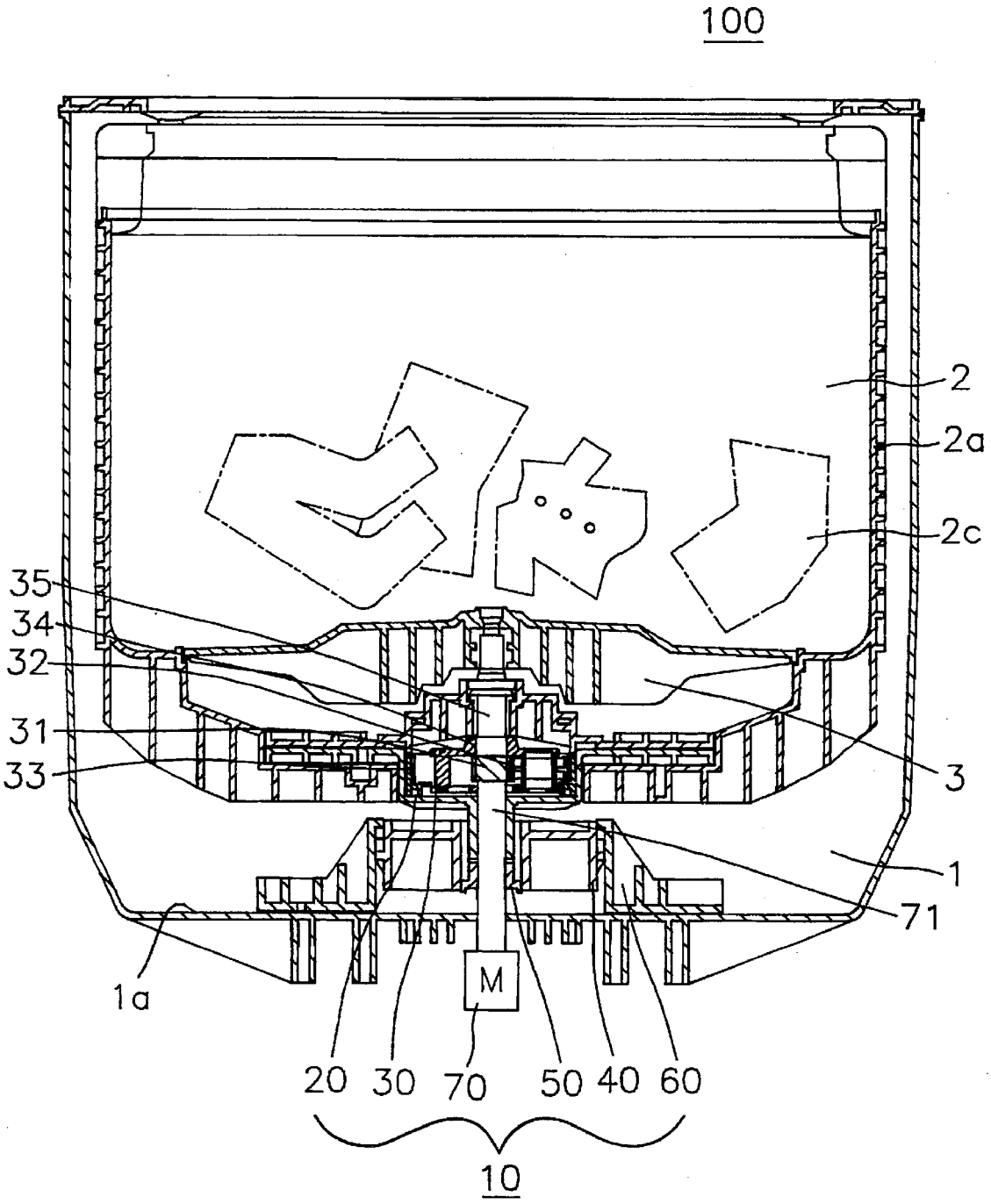

Referring to FIGS. 1A and 1B, there are shown longitudinal sectional views of a washing machine 100 provided with a power transfer apparatus 10 in accordance with the present invention, whose floating gear member 40 is in an upper position and a lower position, respectively. The washing machine 100 is largely divided into a water container 1, a perforated spin tub 2, a pulsator 3, and the power transfer apparatus 10.

In FIG. 1A, the washing machine 100 is in a washing mode wherein the pulsator 3 rotates to produce a vortex flow within the perforated spin tub 2, while the latter 2 is in a stationary condition. The water container 1, as a main frame of the washing machine 100, is filled with washing water during the washing mode.

The perforated spin tub 2 provided with a side wall 2*a* adapted to communicate with the water container 1 is also charged with the washing water during the washing mode. The perforated spin tub 2, within which laundry articles 2*c* are deposited, is rotatably mounted within the water container 1.

The pulsator 3 is used to make a vortex flow within the perforated spin tub 2. The pulsator 3 is rotatable with respect to the perforated spin tub 2 and the water container FIG. 1B illustrates a dewatering mode of the washing machine 100, wherein the perforated spin tub 2 and the pulsator 3 rotate at a same angular velocity to dry or dehydrate washed laundry articles. The washing water used in the washing mode is drained from the water container 1 and the perforated spin tub 2 prior to the dewatering mode.

The power transfer apparatus 10 is used to coordinate the movement of the perforated spin tub 2 and the pulsator 3 according to the operating mode of the washing machine 100. The power transfer apparatus 10 includes the gear case 20, a planetary gear system 30, the floating gear member 40, a gear shaft 50, an cylindrical support 60 and a driving motor 70.

Figure 2:
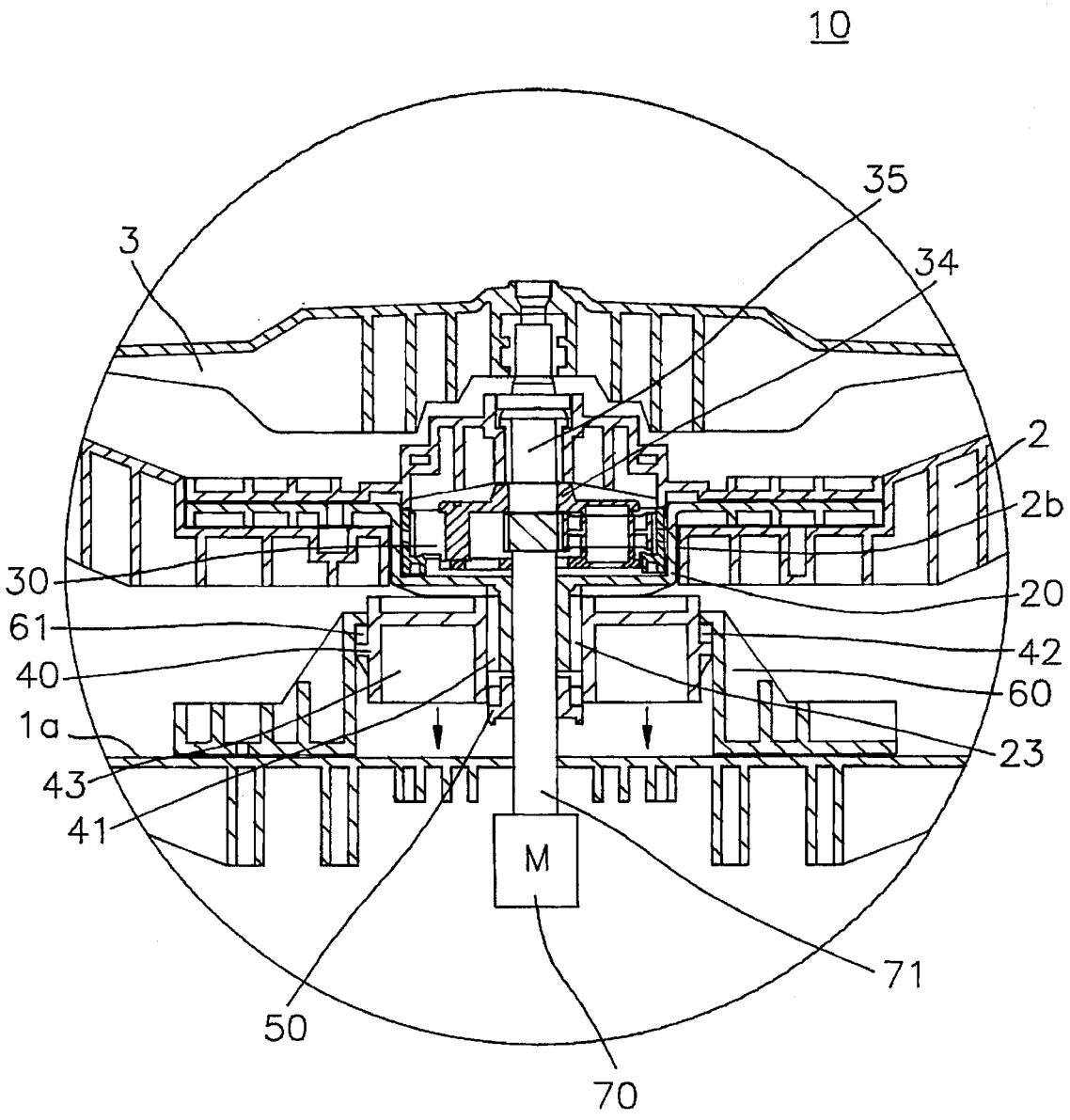
FIG. 2 shows an enlarged sectional view of the power transfer apparatus shown in FIG. 1A.

Detailed description of each of the components constituting the power transfer apparatus 10 is now made with reference to relevant drawings and FIG. 2 which shows an enlarged view of the power transfer apparatus in FIG. 1A.

Figure 3:
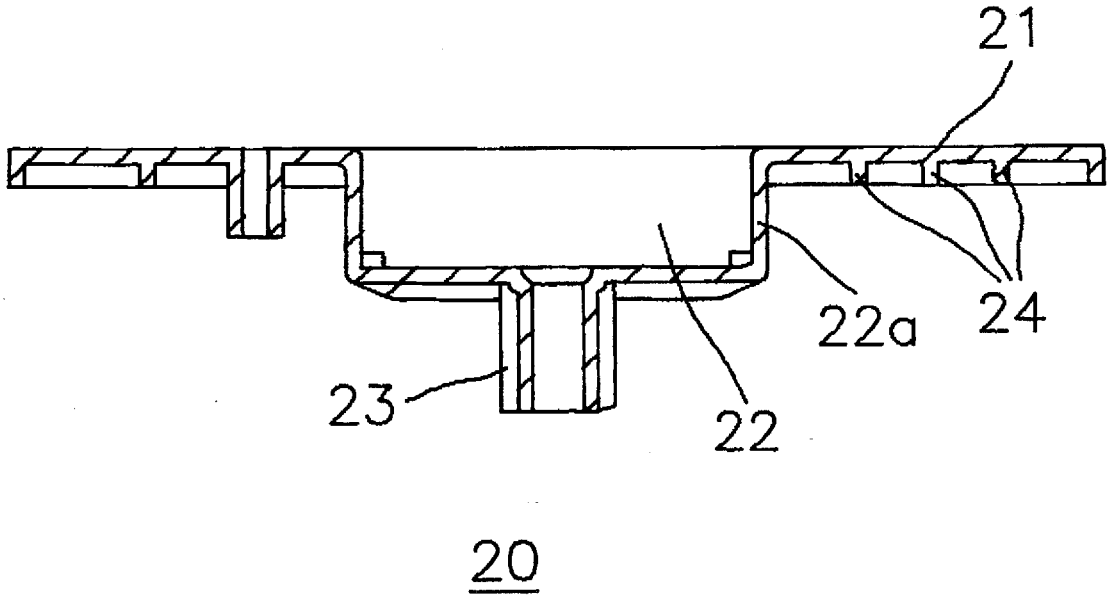
FIG. 3 presents a frontal elevational sectional view of a gear case constituting the inventive power transfer apparatus.

The gear case 20 is installed on an inner drum 2*b* of the perforated spin tub 2; and provides a place for mounting the planetary gear system 30 therein. As shown in FIG. 3, the gear case 20 includes a main disc 21, an annular recess 22 and an external spline gear 23. A plurality of ribs 24 are shaped on the main disc 21 to reinforce the intensity of the gear case 20. The external spline gear 23 downwardly extends from the annular recess 22. The annular recess 22 concavely formed from the main disc 21 contains the planetary gear system 30 therein. The gear case 20 is secured to the perforated spin tub 2 at a wall 22*a* of the annular recess 22 and the main disc 21 (see FIG. 2).

Figure 4A:
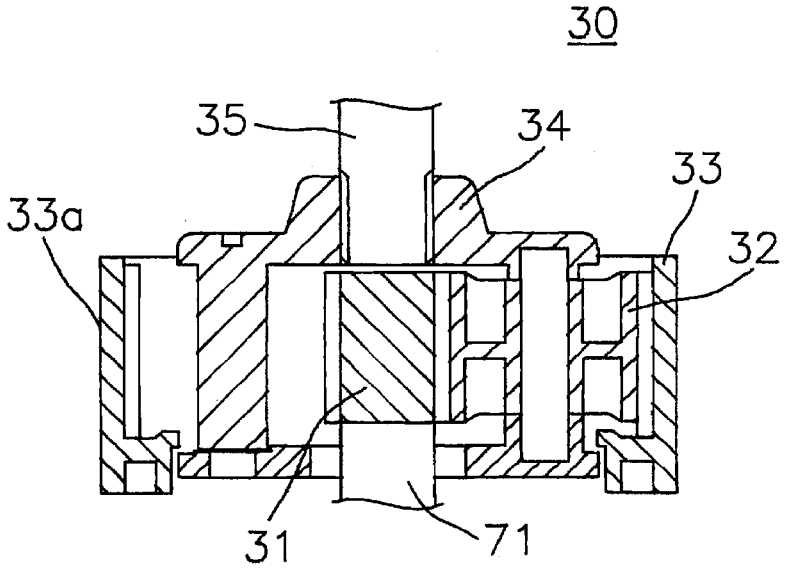
FIG. 4A illustrates a side elevational sectional view of a planetary-gear system employed in the inventive power transfer apparatus.
Figure 4B:
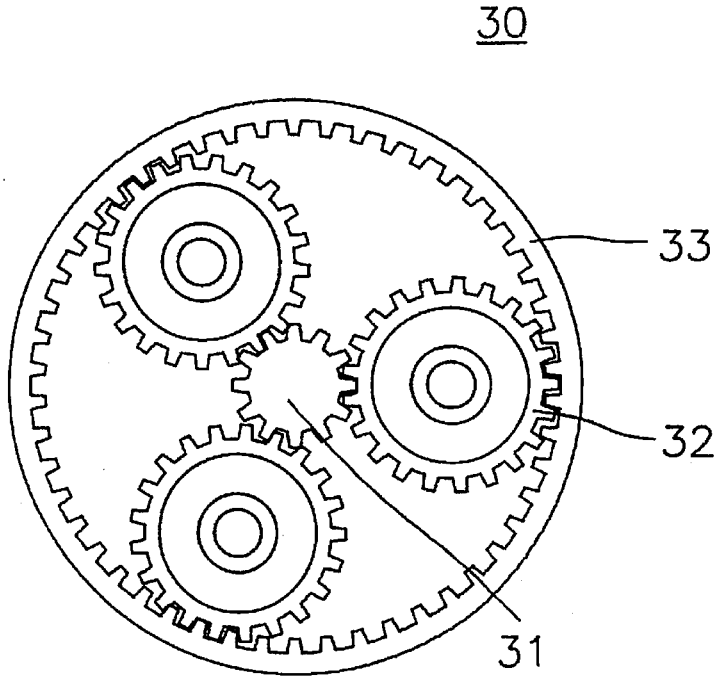
FIG. 4B offers a schematic sectional plan view of the planetary-gear system employed in the inventive power transfer apparatus.

Referring to FIGS. 2, 4A and 4B, the planetary gear system 30 installed within the annular recess 22 includes a sun gear 31, a triplet of planet pinions 32 and an internal gear 33. The sun gear 31 is fixed to a driving shaft 71 from the driving motor 70. The internal gear 33, otherwise called a ring gear, is fixed to the annular recess 22 on its external surface 33*a*. Accordingly, if the gear case 20 is driven, the perforated spin tub 2 and the internal gear 33 turn together. Each of the planet pinions 32 positioned between the sun gear 31 and the internal gear 33 is held to a pinion carrier 34 whose carrier shaft 35 is connected to the pulsator 3 (see FIG. 2).

As shown in FIG. 4B, if the internal gear 33 is held stationary and the sun gear 31 is rotated by the driving shaft 71, the pinion carrier 34 rotates in a same direction as that of the sun gear 31. This occurs when the washing machine 100 is in the washing mode, wherein the pulsator 3 rotates in response to a rotational movement of the driving motor 70, while the perforated spin tub 2 is at a standstill.

If the sun gear 31 and the internal gear 33 are simultaneously rotated at an identical angular velocity, each of the planet pinions 32 is locked between the sun gear 31 and the internal gear 33 and, as a result, the pinion carrier 34 rotates along with the sun gear 31 and the internal gear 33 at the same angular velocity. That is, the entire planetary gear system 30 is rotated at an identical angular velocity, with its components 31, 32 and 33 being locked onto one other. During the dewatering process of the laundry articles 2*c*, the pulsator 3 and the perforated spin tub 2 are mutually locked and rotate together.

Figure 5A:
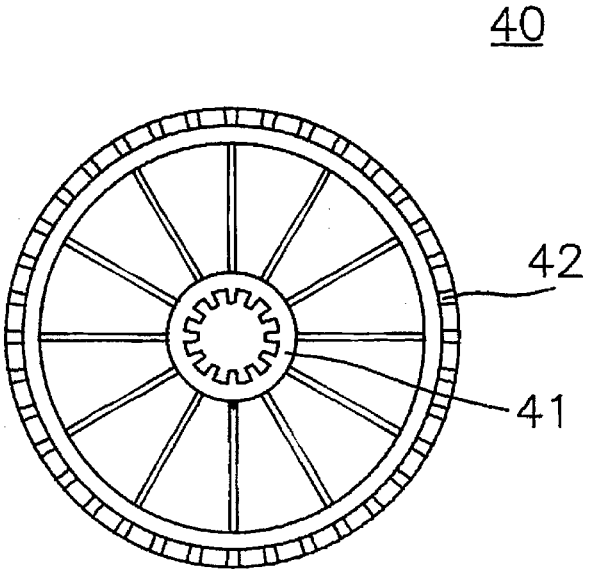
FIG. 5A depicts a top view of a floating gear member of the inventive power transfer apparatus.
Figure 5B:
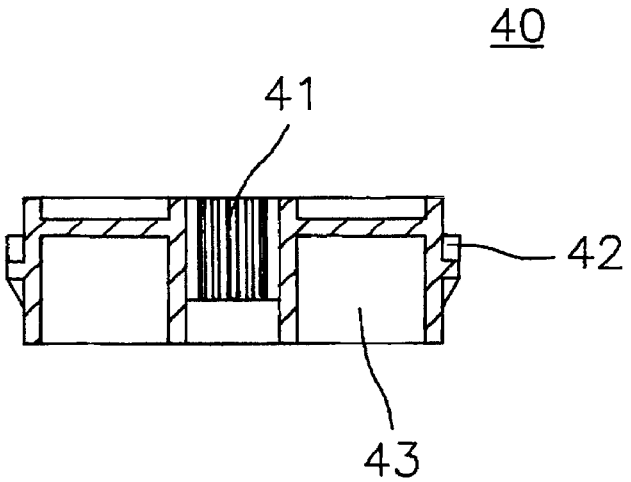
FIG. 5B provides a frontal elevational sectional view of the floating gear member in FIG. 5A.

Referring to FIGS. 2, 5A and 5B, the floating gear member 40 is longitudinally and slidably mounted on the external spline gear 23 of the gear case 20. It includes an internal spline gear 41 meshed with the external spline gear 23, and a plurality of floater teeth 42 upwardly formed on its periphery. The floating gear member 40 further includes a plurality of air chambers 43 of a total volume sufficient to generate a needed buoyant force to lift the floating gear member 40 when the water container 1 is filled with the washing water. The floating gear member 40 is, preferably, made of hydrolysis resistant material, for example, nylon-66, to obtain a desired intensity.

Figure 6:
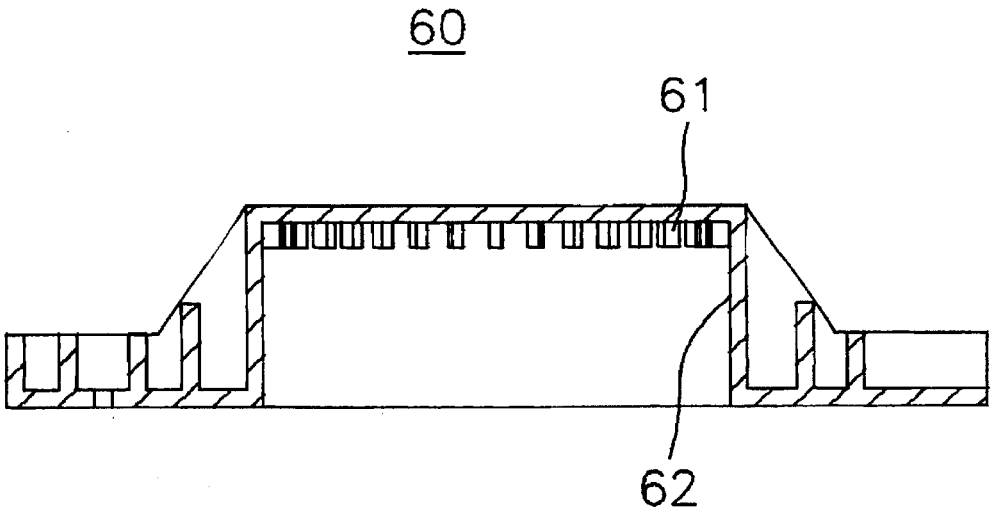
FIG. 6 describes a side elevational sectional view of a cylindrical support of the inventive power transfer apparatus.

Referring to FIGS. 2 and 6, the floating gear member 40 is laterally surrounded by the cylindrical support 60 which is fixed to a bottom surface 1*a* of the water container 1. The cylindrical support 60 has a plurality of supporter teeth 61 downwardly and internally formed at its inner surface 62. The supporter teeth 61 are meshedly engageable with the floater teeth 42.

Figure 7:
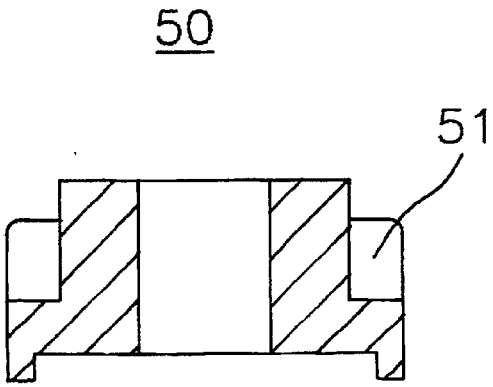
FIG. 7 discloses a side elevational sectional view of a gear shaft of the inventive power transfer apparatus.

Referring to FIGS. 2 and 7, the gear shaft 50 fixed to a lower portion of the driving shaft 71 under the external spline gear 23 is provided with a plurality of shaft teeth 51 upwardly formed at its periphery.

As shown in FIG. 2, the floating gear member 40 is slidable on and along the external spline gear 23 of the gear case 20 within the cylindrical support 60 from an upper position to a lower position. At the upper position, the floating gear member 40 is connected to the cylindrical support 60 through the teeth 61 and 42 (61 alone is shown), with its internal spline gear 41 being meshed with only the external spline gear 23 of the gear case 20. And at the lower position, the internal spline gear 41 is meshed with the external spline gear 23 together with the shaft teeth 51 of the gear shaft 50 and the floater teeth 42 are disengaged from the supporter teeth 61.

Turning back to FIG. 1A, in the washing mode, if the water container 1 is filled with the washing water, the floating gear member 40 is raised and connected to the cylindrical support 60 fixed to the lower surface la of the water container 1. This causes the floating gear member 40, the gear case 20 and the perforated spin tub 2 to be immovable with respect to the water container 1. Consequently, the internal gear 33 fixed to the gear case 20 also becomes immovable. Then, if the driving shaft 71 from the driving motor 70 is rotated in order to accommodate the washing action of the washing machine 100, the sun gear 31 turns, driving the pinion carrier 34, while the internal gear 33 is in the immovable condition. As a result, the pulsator 3 fixed to the carrier shaft 35 is driven to generate a vortex flow within the spin tub 2, while the latter 2 is locked to the water container 1.

Referring to FIG. 1B, if the washing water is drained from the water container 1 for the dewatering of the laundry articles 2*c*, the floating gear member 40 becomes released from the cylindrical support 60 and gets sunk. In this mode, power from the driving motor 70 is transferred through two different paths, simultaneously. The driving shaft 71, the gear shaft 50, the floating gear member 40, the gear case 20 and the internal gear 33 of the planetary gear system 30 constitute one path for transferring the power from the driving motor 70 The perforated spin tub 2 is rotated by the driving motor 70 through this path. The other path is comprised of the driving shaft 71 and the sun gear 31 of the planetary gear system 30 The rotational movement of the driving motor 70 is transferred to the sun gear 31 together with the internal gear 33 at the same time. This causes each of the planet pinions 32 to be locked between the sun and the internal gears 31 and 33, resulting in the carrier shaft 35 to be rotated at an identical angular velocity to that of the sun and the internal gears. 31 and 33. The perforated spin tub 2 and the pulsator 3, therefore, rotate together during the dewatering process of the laundry articles 2*c*.

Although the invention has been shown and described with respect to the preferred embodiments, it will be understood by those skilled in the art that various changes and modifications may be made without departing from the spirit and scope of the invention as defined in the following claims.

What is claimed is:

1. A power transfer apparatus for use in a washing machine provided with a water container, a spin tub rotatable within the water container, a pulsator rotatable within the spin tub, and driving means with a driving shaft, said apparatus comprising:

a gear shaft fixed to the driving shaft and including a plurality of first connection teeth formed on its periphery;

a gear case rotatable about the driving shaft, fixed to the spin tub and including a spline gear downwardly extending therefrom;

planetary gear means including a first gear element connected to the driving shaft, a second gear element connected to the pulsator, and a third gear element secured to the gear case;

a cylindrical support fixed to the water container to surround the driving shaft and including a plurality of second connection teeth on its inner surface; and clutch means for connecting the spline gear of the gear case to the first connection teeth, while keeping the gear case disconnected from the cylindrical support for a dewatering action of the machine, and for connecting the spline gear of the gear case to the second connection teeth, while keeping the gear case disconnected from the gear shaft for a washing action of the machine.

2. The power transfer apparatus of claim 1, wherein the planetary gear means is a planetary gear system in which the first gear element is a sun gear, the second gear element is made of at least one planet pinion and the third gear element is an internal gear.

3. The power transfer apparatus of claim 1, wherein the clutch means is a cylindrical floating member which includes a spline gear meshable with the first connection teeth and the spline gear of the gear case, a plurality of third connection teeth meshable with the second connection teeth, and a plurality of air chambers of a total volume sufficient to generate a buoyant force to thereby lift the cylindrical floating member when the water container is filled with the washing water.

4. The power transfer apparatus of claim 3, wherein the cylindrical floating member is made of a hydrolysis resistant material.

* * * * *